US006004055A

United States Patent [19]

Cheng

[11] Patent Number: 6,004,055

[45] Date of Patent: Dec. 21, 1999

[54] NAIL ENAMEL CONTAINER

[76] Inventor: Chen-An Cheng, No. 33, Lane 340, Section 1, Hai Tian Road, Tainan, Taiwan

[21] Appl. No.: 09/290,228

[22] Filed: Apr. 13, 1999

[51] Int. Cl.[6] ..... A45D 34/04; A45D 29/00

[52] U.S. Cl. ..... 401/126; 401/37; 401/129; 132/74.5; 132/75

[58] Field of Search ..... 401/37, 126, 129; 132/73, 73.5, 74.5, 76.4, 75, 309, 329

[56] References Cited

U.S. PATENT DOCUMENTS

| | | | |
|---|---|---|---|
| 1,955,419 | 4/1934 | Gerard | 132/74.5 |
| 2,046,002 | 6/1936 | Hunter | 132/74.5 |
| 2,888,020 | 5/1959 | Schultz | 132/74.5 |
| 4,522,523 | 6/1985 | Vogelsang | 401/126 |
| 5,397,195 | 3/1995 | Goncalves | 401/277 |
| 5,746,529 | 5/1998 | Peters et al. | 401/126 |
| 5,762,077 | 6/1998 | Griffiths, Jr. | 132/74.5 |

*Primary Examiner*—Charles R. Eloshway
*Attorney, Agent, or Firm*—Rosenberg, Klein & Lee

[57] ABSTRACT

A nail enamel container is composed by a main body, a sleeve member and a cap. The main body is provided with a neck on one end, and an entrance is provided in the neck for the brush of the cap to be inserted through and into the interior of the main body. A protruding connecting portion is provided on the other end of the main body so as to be sleeved in the hollow in one end of the sleeve member. A screwing section is provided on the other end of the sleeve member, and an engraving needle is provided to protrude outwardly of the front end of the screwing section. After the enamel on the nails has been air-dried, the engraving needle is used to engrave various designs or characters on the enamel on the nails so as to make the nails look vivid, and shining.

2 Claims, 4 Drawing Sheets

NAIL ENAMEL CONTAINER

BACKGROUND OF THE INVENTION

1. Field of the Invention

The present invention relates to a nail enamel container with innovative practical features, and more particularly to a nail enamel container with an enamel brush and an engraving needle which is provided for a user to engrave designs or characters on the air-dried enamel applied to the nails of a person so as to promote visual sense of beauty and have fun.

2. Description of the Related Art

As the trend of the times constantly changes, fashions have become indispensable spiritual enjoyment in our daily life. Currently, various new articles of daily use and decorations are constantly created and brought forth by inventors and fashion-leaders.

Referring to FIGS. 1 and 2, a conventional nail enamel container commonly sold in the market is composed by a main body I filled with enamel 11 in the interior and a cap 2 provided with a shaft 21 and a brush 22 inserted into the main body 1. While being used, the cap 2 is turned away from the main body 1 so as to be stained with moderate enamel 11, and then the enamel 11 is brushed on the nails of a person. After the enamel 11 on the nails being air-dried, the nails will be colorful and shining.

However, it is no longer the fashion just to brush enamel on the nails because the using manner is mechanical, does not promote visual sense of beauty and is fun.

SUMMARY OF THE INVENTION

Accordingly, the present invention is directed to a nail enamel container which can substantially increase the practical effect, lead the fashion, and further promote the visual sense of beauty fun.

An object of the present invention is to provide a nail enamel container which is small and light so that it is convenient to be carried.

Another object of the present invention is to provide a nail enamel container whose engraving needle is combined with the conventional nail enamel container so that it is convenient for a user to brush enamel on nails or to engrave designs or characters on the air-dried enamel on nails.

Yet another object of the present invention is to provide a nail enamel container which is provided with an engraving needle for a user to engrave designs or characters on the air-dried enamel so as to promote the visual sense of beauty and fun.

To achieve these advantages, a nail enamel container in the present invention is composed by a main body, a sleeve member and a cap. The main body is provided with a neck on one end, and an entrance is provided in the neck for the brush of the cap to be inserted through and into the interior of the main body. A protruding connecting portion is provided on the other end of the main body so as to be sleeved in the hollow in one end of the sleeve member. A screwing section is provided on the other end of the sleeve member, and an engraving needle is provided to protrude outward the front end of the screwing section. After the enamel on the nails being air-dried, the engraving needle is used to engrave various designs or characters on the enamel on the nails so as to make the nails look vivid, shining and to have fun.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 4:
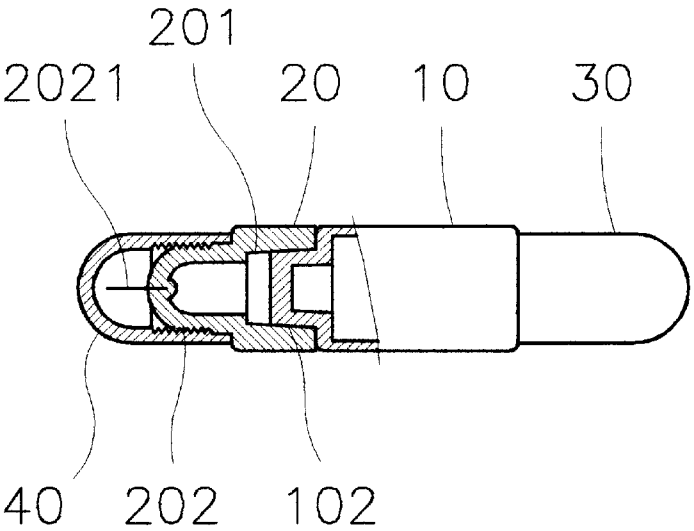
FIG. 4 is a sectional view of the sleeve member in an assembled configuration in accordance with the present invention; and, FIG. 5 is a perspective view showing a user using the engraving needle in accordance with an embodiment of the present invention to engrave designs and characters on the air-dried enamel on the nails.
Figure 1:
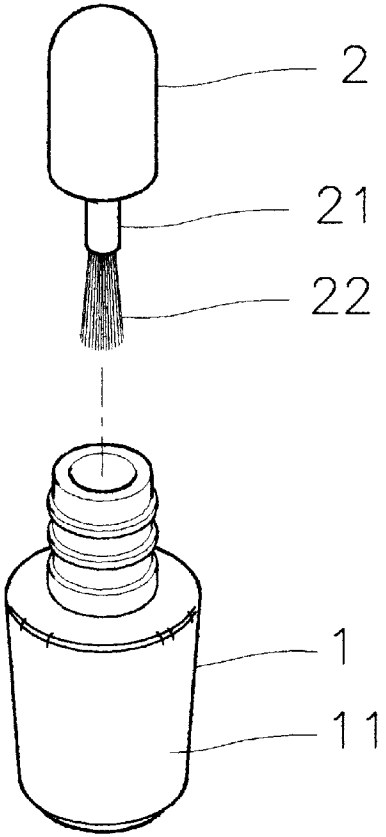
FIG. 1 (PRIOR ART)
FIG. 1 is a perspective exploded view of a conventional nail enamel container.
Figure 2:
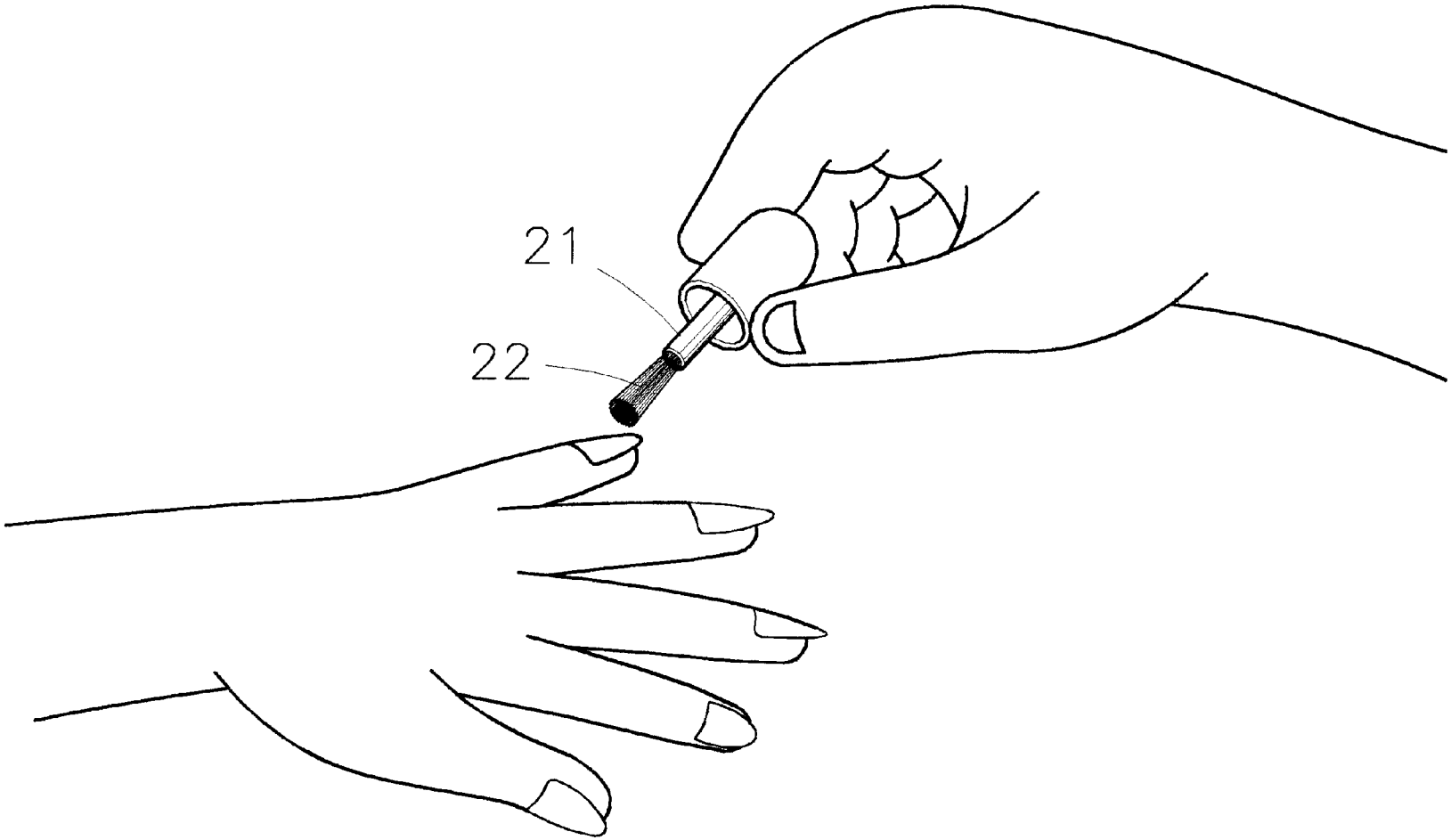
FIG. 2 (PRIOR ART)
FIG. 2 is a perspective view showing the enamel is brushed on the nails by a user in accordance with the conventional nail enamel container.
Figure 3:
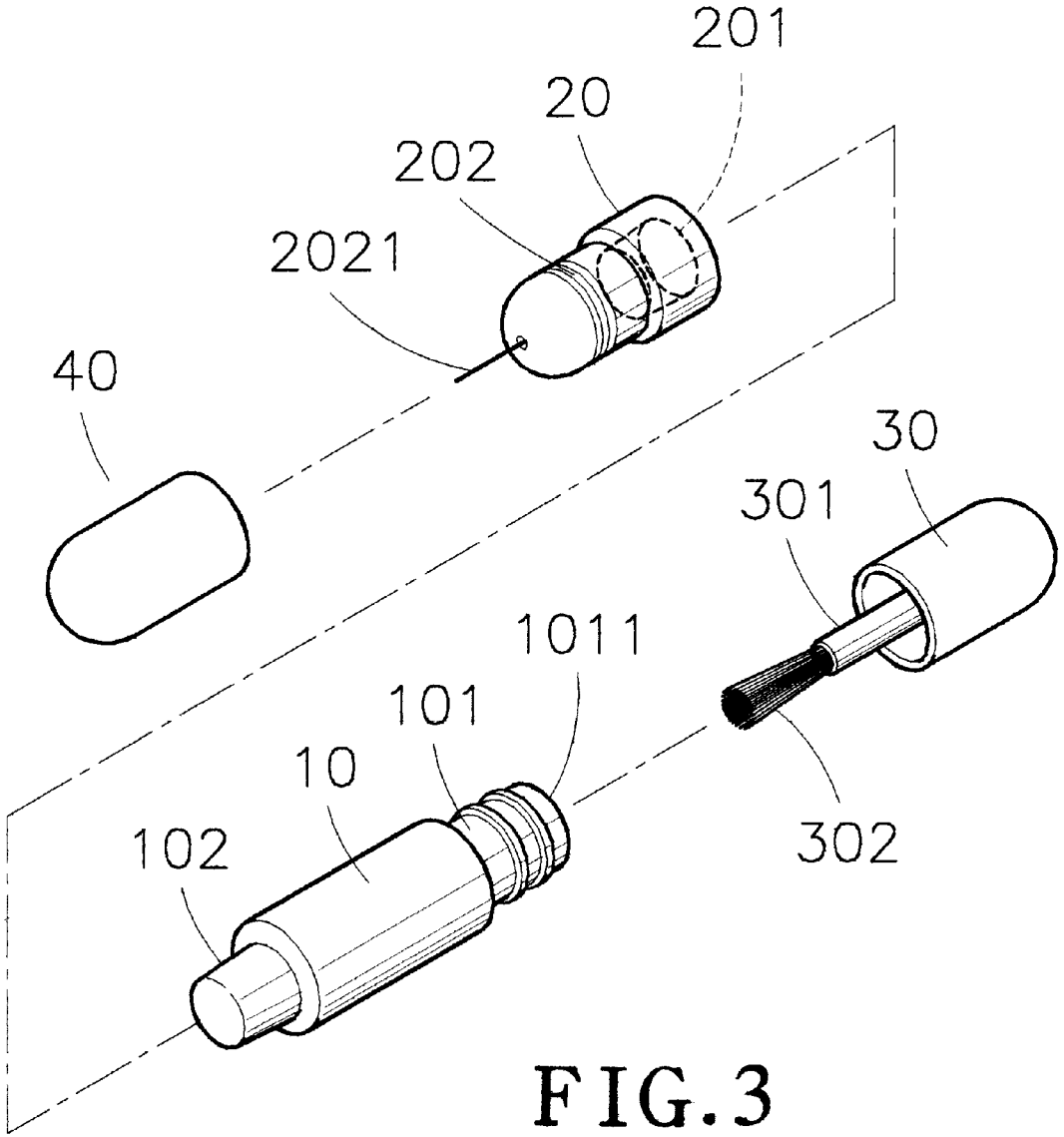
FIG. 3 is a perspective exploded view of an embodiment of the nail enamel container in accordance with the present invention.
Figure 5:
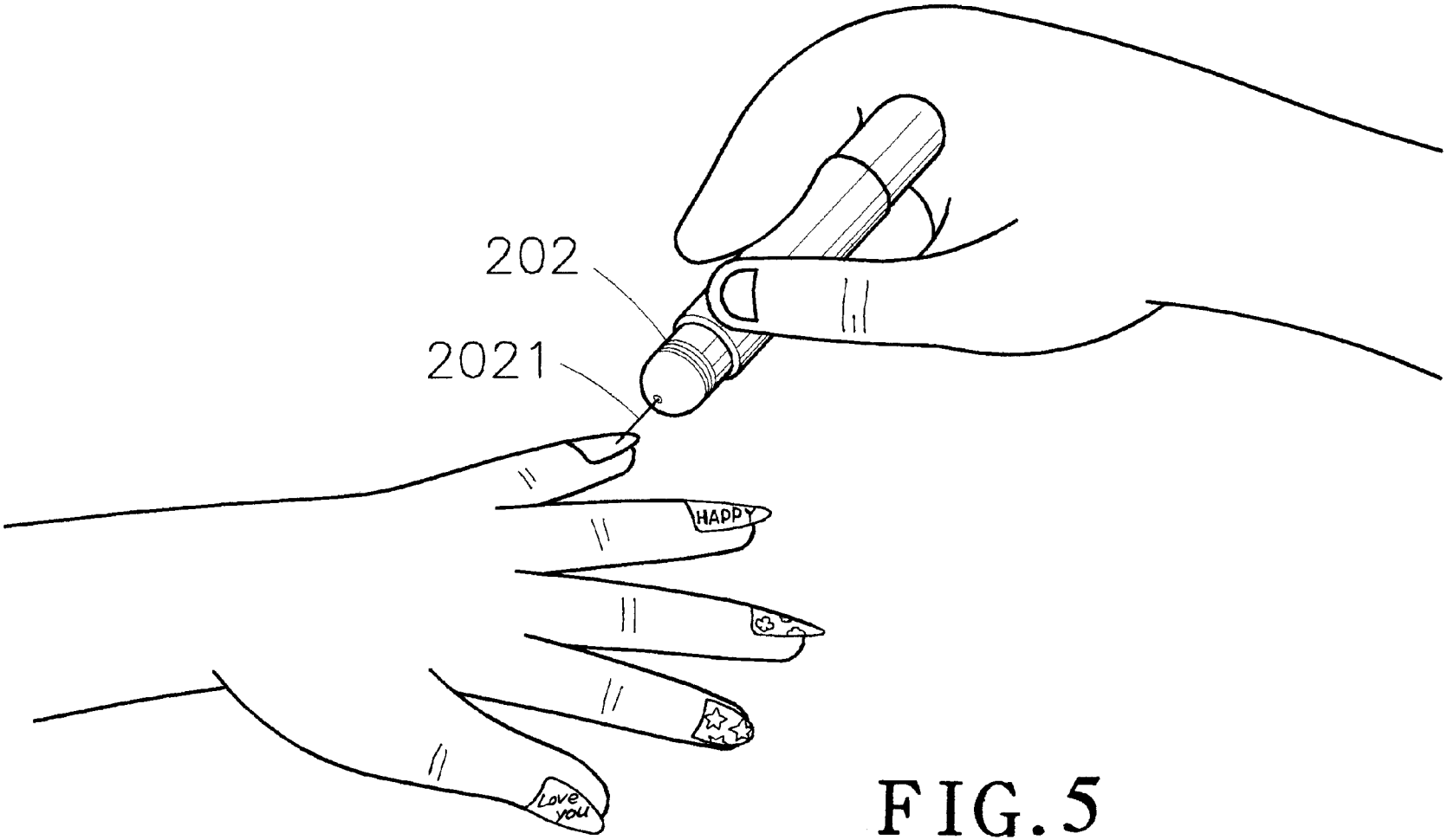

Referring to FIGS. 3, 4 and 5, a preferred embodiment of a nail enamel container in the present invention includes a main body 10, a sleeve member 20, and caps 30, 40.

The main body 10 is integrated and provided with a neck 101 on one end, and an entrance 1011 is provided in the neck 101. A protruding connecting section 102 is provided on the other end of the main body 10. The interior of the main body 10 is hollow so as to be filled with enamel.

The sleeve member 20 is provided with a hollow 201 in one end, and a screwing section 202 is provided on the other end. An engraving needle 2021 is provided outward the front end of the screwing section 202.

The cap 30 is hollow and is provided with a protruding shaft 301 as well as a brush 302 in the front end. The other cap 40 is shaped as a hollow semi-cylinder.

While being assembled, referring to FIGS. 4 and 5, the protruding connecting section 102 of the main body 10 is sleeved in the hollow 201 of the sleeve member 20, and two caps 30,40 are respectively screwed to cap the neck 101 of the main body 10 and the screwing section 202 of the sleeve member 20.

While being used, the cap 30 on the neck 101 of the main body 10 is turned to separate from the main body 10, and then the brush 302 of the cap 30 is inserted into the main body 10 so as to be stained with moderate enamel and to brush the enamel on the nails of a person. After the enamel on the nails being air-dried, the other cap 40 is taken off and the main body 10 together with the sleeve member 20 is held so that the engraving needle can be used to engrave various designs or characters on the air-dried enamel on the nails of a person. Accordingly, not only the user would have fun while engraving but also the nails will look vivid and shining.

While the preferred embodiments of the invention have been described above, it will be recognized and understood that various modifications may be made therein and the appended claims are intended to cover all such modifications which may fall within the spirit and scope of the invention.

What is claimed is:

1. A nail enamel applicator and decorating device comprising:

a hollow main body for filling with nail enamel and provided with a neck on one end;

an entrance provided in said neck;

a cap having a depending applicator, said cap sealing said entrance when attached to said neck, said applicator being received in said main body through said entrance for contact with the nail enamel;

a protruding connecting section extending from the opposite end of said main body in a direction away from the interior of said main body;

a sleeve member having a hollow in one end for receiving said protruding connecting section therein and a threaded section on an opposite end for receiving a threaded cap thereon, and an engraving needle integral with said opposite end of said sleeve member and extending outwardly therefrom, said engraving needle for engraving designs on the nail enamel after it has dried on the user's nails.

2. The nail enamel applicator and decorating device as recited in claim 1, wherein said engraving needle is made of metal.

* * * * *